US011998040B2

(12) United States Patent
Stefani et al.

(10) Patent No.: US 11,998,040 B2
(45) Date of Patent: Jun. 4, 2024

(54) NON-COMBUSTIBLE WRAPPER FOR USE IN HEAT BUT NOT BURN APPLICATIONS

(71) Applicant: Schweitzer-Mauduit International, Inc., Alpharetta, GA (US)

(72) Inventors: Bruno Stefani, Le Mans (FR); Lanig Le Bec, Tregunc (FR)

(73) Assignee: SWM Holdings US, LLC, Alpharetta, GA (US)

( * ) Notice: Subject to any disclaimer, the term of this patent is extended or adjusted under 35 U.S.C. 154(b) by 414 days.

(21) Appl. No.: 17/224,783

(22) Filed: Apr. 7, 2021

(65) Prior Publication Data

US 2021/0307381 A1 Oct. 7, 2021

Related U.S. Application Data

(60) Provisional application No. 63/006,576, filed on Apr. 7, 2020.

(51) Int. Cl.

| | |
|---|---|
| ***A24D 1/20*** | (2020.01) |
| ***A24D 1/02*** | (2006.01) |
| ***D21H 17/67*** | (2006.01) |
| ***D21H 17/68*** | (2006.01) |
| ***D21H 19/10*** | (2006.01) |
| ***D21H 21/34*** | (2006.01) |
| ***D21H 21/52*** | (2006.01) |

(52) U.S. Cl.

CPC ..... *A24D 1/20* (2020.01); *A24D 1/02* (2013.01); *D21H 17/675* (2013.01); *D21H 17/68* (2013.01); *D21H 19/10* (2013.01); *D21H 21/34* (2013.01); *D21H 21/52* (2013.01)

(58) Field of Classification Search

None

See application file for complete search history.

(56) References Cited

U.S. PATENT DOCUMENTS

| | | | |
|---|---|---|---|
| 2,592,554 | A | 4/1952 | Frankenburg |
| 2,626,612 | A | 1/1953 | Pearce |
| 3,145,717 | A | 8/1964 | Osborne et al. |
| 3,584,631 | A | 6/1971 | Halter et al. |
| 3,820,548 | A | 6/1974 | Buchmann et al. |
| 4,497,331 | A | 2/1985 | Nellen |
| 4,681,126 | A | 7/1987 | Strubel et al. |

(Continued)

FOREIGN PATENT DOCUMENTS

| | | | |
|---|---|---|---|
| CN | 104872810 | A | 9/2015 |
| CN | 110284370 | A | 9/2019 |

(Continued)

OTHER PUBLICATIONS

"The Mineral Kaolinite", Minerals.net, [online], retrieved from the Internet, [retrieved Jun. 27, 2023], URL:https://www.minerals.net/mineral/kaolinite.aspx. (Year: 2023).*

(Continued)

*Primary Examiner* — Dennis R Cordray

(74) *Attorney, Agent, or Firm* — Dority & Manning, P.A.

(57) ABSTRACT

A paper well suited for use as a wrapper in heat but not burn sticks is disclosed. The paper includes a base web made from cellulosic fibers combined with a flame retardant filler and/or can include a coating formed from a reduced ignition composition.

23 Claims, 4 Drawing Sheets

(56) References Cited

U.S. PATENT DOCUMENTS

| | | | | |
|---|---|---|---|---|
| 4,739,775 | A | 4/1988 | Hampl, Jr. | |
| 4,987,906 | A | 1/1991 | Young et al. | |
| 5,143,097 | A | 9/1992 | Stephen Sohn et al. | |
| 5,159,942 | A | 11/1992 | Brinkley et al. | |
| 5,203,355 | A | 4/1993 | Clearman et al. | |
| 5,322,076 | A | 6/1994 | Brinkley et al. | |
| 5,325,877 | A | 7/1994 | Young et al. | |
| 5,339,838 | A | 9/1994 | Young et al. | |
| 5,377,698 | A | 1/1995 | Litzinger et al. | |
| 5,417,228 | A | 5/1995 | Baldwin et al. | |
| 5,501,237 | A | 3/1996 | Young et al. | |
| 5,533,530 | A | 7/1996 | Young et al. | |
| 5,715,844 | A | 2/1998 | Young et al. | |
| 5,724,998 | A | 3/1998 | Gellatly et al. | |
| 5,765,570 | A | 6/1998 | Litzinger et al. | |
| 5,908,034 | A | 6/1999 | Adedeji | |
| 7,428,905 | B2 | 9/2008 | Mua | |
| 8,007,637 | B2 | 8/2011 | Liu et al. | |
| 9,578,897 | B2 | 2/2017 | Gladden et al. | |
| 10,791,756 | B2 | 10/2020 | Zuchuat et al. | |
| 10,966,461 | B2 | 4/2021 | Plojoux et al. | |
| 2006/0021626 | A1 | 2/2006 | Mua | |
| 2013/0146075 | A1* | 6/2013 | Poget | A24D 1/02 131/360 |
| 2015/0068544 | A1 | 3/2015 | Moldaveanu et al. | |
| 2021/0120867 | A1* | 4/2021 | Sakurai | D21H 27/10 |

FOREIGN PATENT DOCUMENTS

| | | | |
|---|---|---|---|
| CN | 110629583 | A | 12/2019 |
| EP | 0 304 766 | A2 | 3/1989 |
| EP | 0535834 | A1 | 4/1993 |
| EP | 0565360 | A2 | 10/1993 |
| EP | 0704171 | A2 | 4/1996 |
| EP | 1790240 | A1 | 5/2007 |
| EP | 2644043 | A1 | 10/2013 |
| GB | 1413177 | A | 11/1975 |
| GB | 1426095 | A | 2/1976 |
| WO | WO 96/07336 | A2 | 3/1996 |
| WO | WO 02/37991 | A1 | 5/2002 |
| WO | WO 2009/006570 | A2 | 1/2009 |
| WO | WO 2011/117750 | A2 | 9/2011 |
| WO | WO 2012/164009 | A2 | 12/2012 |
| WO | WO 2013/178769 | A1 | 12/2013 |
| WO | WO 2016/026810 | A1 | 2/2016 |
| WO | WO 2016/207407 | A1 | 12/2016 |
| WO | WO 2017/051034 | A1 | 3/2017 |
| WO | WO 2017/097840 | A1 | 6/2017 |
| WO | WO 2017/155739 | A1 | 9/2017 |
| WO | WO 2019/043119 | A1 | 3/2019 |
| WO | WO 2019219869 | A1 | 11/2019 |
| WO | WO 2020/020503 | A1 | 1/2020 |
| WO | WO 2020/074535 | A1 | 4/2020 |

OTHER PUBLICATIONS

International Search Report and The Written Opinion of the International Searching Authority, or the Declaration Corresponding to Application No. PCT/IB2021/052905 dated Jun. 29, 2021.

* cited by examiner

NON-COMBUSTIBLE WRAPPER FOR USE IN HEAT BUT NOT BURN APPLICATIONS

RELATED APPLICATIONS

The present application is based upon and claims priority to Provisional Patent Application Ser. No. 63/006,576, having a filing date of Apr. 7, 2020, and which is incorporated herein by reference.

BACKGROUND

Smoking articles such as cigarettes are conventionally made by wrapping a column of tobacco in a wrapping paper. At one end, the smoking article usually includes a filter through which the article is smoked. Filters are attached to smoking articles using a tipping paper which is glued to the white wrapping paper. The wrapping papers and tipping papers used to construct smoking articles are typically made from flax or other cellulosic fibers and can contain one or more fillers, such as calcium carbonate.

When a smoking article is smoked, mainstream smoke is generated that is inhaled through the filter. Mainstream smoke can contain numerous different components that provide the smoking article with a particular taste, which encompasses the sensations detected not only by one's taste but also by one's sense of smell. In addition to producing mainstream smoke, conventional smoking articles also produce a sidestream smoke. Smoke exhaled by the smoker and the sidestream smoke is typically referred to as secondhand smoke.

In recent years, those skilled in the art have created heated tobacco products that can generate an aerosol and provide the same experience to a user as a conventional cigarette while producing no secondhand smoke. These types of smokeless products are typically referred to as heat but not burn sticks. Heat but not burn sticks are placed in an aerosol generating machine and subjected to low temperature heating that produces an inhalable aerosol without combusting the product. For instance, a heat but not burn stick can contain tobacco that is heated to produce an aerosol without burning the tobacco. The heat but not burn sticks, similar to conventional smoking articles, contain a column of an aerosol generating material surrounded by a wrapper. The aerosol generating material can be made in different formats, such as cut strands from different sheets similar to cigarettes, from a gathered sheet of material, or from cut strands from a single sheet. The heat but not burn stick can be placed in a heating device that heats the stick to a low temperature, such as from about 200° C. to about 450° C. The heating device, for instance, can use an electric element, can burn fuel, or can create a chemical reaction that produces the heat.

In contrast to conventional smoking articles, heat but not burn sticks should be non-combustible. In particular, heat but not burn sticks should not be capable of maintaining a lit end when exposed to an open flame or a high temperature heating element. For example, ideally, heat but not burn sticks should not be capable of being lit and smoked similar to a conventional cigarette. In addition, heat but not burn sticks preferably do not produce any significant amount of combustion products when placed in a heat but not burn device. Further, various governmental regulations now require that heat but not burn sticks not be capable of being used as conventional cigarettes.

In order to address the above concerns, in the past, wrappers for heat but not burn sticks have been made by laminating aluminum to a paper substrate. Although the aluminum is non-combustible, the aluminum can interfere with the ability of the stick to produce a uniform aerosol from start to finish. In addition, the aluminum adds significant expense to the product and is non-biodegradable.

In view of the above, a need exists for an improved wrapper for heat but not burn sticks. In particular, a need exists for an improved wrapper that can render a heat but not burn stick non-combustible.

SUMMARY

In general, the present disclosure is directed to a wrapper for use in constructing heat but not burn sticks. In one aspect, the wrapper is non-combustible even when surrounding a column of tobacco and placed in a conventional smoking machine and ignited. The wrapper of the present disclosure can be made primarily from biodegradable materials and thus is environmentally friendly. In addition, the wrapper can be constructed so as to not adversely interfere with the aerosol producing characteristics of an aerosol generating material contained within the heat but not burn stick.

In order to produce a wrapper for a heat but not burn stick that renders the heat but not burn stick non-combustible, various techniques can be used alone or in combination. For instance, wrappers can be made according to the present disclosure that contain one or more flame retardant fillers. In another aspect, a reduced ignition composition can be applied to one or both sides of the wrapper. In still another aspect, a flame retardant filler can be used in conjunction with a coating made from a reduced ignition composition. The wrappers of the present disclosure can be made from a single layer of paper or base web or can be made from multiple layers. In one aspect, the wrapper contains an outer wrapper and an inner wrapper, wherein the inner wrapper, the outer wrapper, or both incorporate one or more of the above techniques.

In one aspect, the present disclosure is directed to a wrapper fora heat but not burn stick. The wrapper comprises a base web containing cellulosic fibers blended with a flame retardant filler. The base web has a first side and a second and opposite side. The flame retardant filler can comprise calcium silicate particles. The calcium silicate particles, for instance, can be present in the base web in an amount greater than about 10% by weight, such as in an amount greater than about 16% by weight, and generally present in an amount less than about 40% by weight, such as in an amount less than about 30% by weight, such as in an amount less than about 24% by weight.

Alternatively, the flame retardant filler present in the base web can comprise clay particles, other silicate particles, metal hydroxide particles, and the like. For example, the flame retardant filler can comprise kaolin particles, aluminum hydroxide particles, or mixtures thereof. Each filler or each mixture of fillers can be present in the base web in an amount greater than about 10% by weight, such as in an amount greater than about 16% by weight, and generally present in an amount less than about 40% by weight, such as in an amount less than about 30% by weight, such as in an amount less than about 24% by weight.

The wrapper further includes a coating disposed on the first side of the base web. The coating comprises a reduced ignition composition. For example, the coating can comprise a reduced ignition substance alone or in combination with a viscosity modifier, a spacer and/or filler particles. The reduced ignition substance, for instance, can comprise microcrystalline cellulose, an alginate, a starch, or mixtures thereof. The microcrystalline cellulose can be ground microcrystalline cellulose, powdered microcrystalline cellulose, or colloidal microcrystalline cellulose. In one aspect the microcrystalline cellulose is depolymerized. The viscosity modifier or spacer can comprise a cellulose derivative, such as carboxy methylcellulose, guar gum or any other suitable natural or synthetic polymer.

As described above, the base web contains a flame retardant filler comprising calcium silicate particles. In one aspect, the calcium silicate particles are uncoated, meaning that the particles are not coated with a dissimilar material. In general, the calcium silicate particles can have an average particle size of from about 0.1 microns to about 30 microns, such as from about 2 microns to about 15 microns. As used herein, the particle size of the fillers can be determined through light scattering or laser diffraction. Such particle size analyzers are available commercially through Horiba Scientific, such as the LA-960 particle size analyzer. The base web can be constructed so that it only contains the flame retardant filler alone or can be constructed so that it contains the flame retardant filler in combination with other fillers.

The base web can have a basis weight of from about 12 gsm to about 80 gsm. The base web can have an inherent permeability of from about 0 CU to about 50 CU, such as from about 0 CU to about 20 CU. As used herein, an "inherent" permeability refers to the permeability of the base web prior to applying any coatings or surface treatments (such as perforations).

The coating of the reduced ignition composition can be a continuous coating or a discontinuous coating. As used herein, a continuous coating is a coating that is uninterrupted over the treated area of the substrate. A discontinuous coating, on the other hand, is a coating that is interrupted over the treated area forming untreated areas within the treated areas. A wrapper that includes a plurality of spaced apart circumferential bands formed by a coating composition, for instance, is a discontinuous coating as used herein.

When the coating is a continuous coating, the coating can cover generally greater than about 40%, such as greater than about 65%, such as greater than about 80%, such as greater than about 85%, such as greater than about 90%, such as greater than about 95% of the surface area of the first side of the base web. Where the coating is disposed, the coating can have a basis weight of from about 0.5 gsm to about 10 gsm.

The wrapper in accordance with the present disclosure can be a single layer wrapper or can include a plurality of layers. For instance, the wrapper can include two layers. When containing a plurality of layers, the base web of the present disclosure comprises one of the layers. In one aspect, for instance, the base web can be the inner layer of a two-layer wrapper or can be the outer layer of a two-layer wrapper.

In another aspect, the wrapper of the present disclosure for a heat but not burn stick includes an outer wrapper comprising cellulosic fibers and an inner wrapper comprising a base web. The base web contains cellulosic fibers blended with a flame retardant filler. The flame retardant filler, for instance, can be silicate particles, such as calcium silicate particles, clay particles, such as kaolin particles, or metal hydroxide particles, such as aluminum hydroxide particles. The flame retardant filler can be present in the base web in an amount from about 10% to about 45% by weight, such as from about 27% to about 38% by weight. The base web can have a basis weight of from about 20 gsm to about 50 gsm. In this embodiment, the base web can be uncoated meaning that the base web is not treated with any reduced ignition composition while still providing the wrapper with desired non-combustion properties.

In still another aspect, the present disclosure is directed to a wrapper for a heat but not burn stick that comprises a base web containing cellulosic fibers. The base web can have a first side and a second and opposite side. The base web can include a coating disposed on the first side of the base web formed from a reduced ignition composition. The coating can be continuous and can cover greater than about 65% of the surface area of the first side of the base web, such as greater than about 80% of the surface area of the first side of the base web. Where coated with the reduced ignition composition, the base web can have a permeability of less than about 10 CU, such as less than about 5 CU, such as less than about 2 CU, and can have a diffusivity where coated of less than about 0.04 cm/s, such as less than about 0.03 cm/s, such as less than about 0.02 cm/s. In this embodiment, the base web can optionally contain filler particles. The filler particles, when present, can comprise calcium carbonate particles or magnesium oxide particles. Alternatively, the base web can be free of any filler materials. In this embodiment, the wrapper can be a single layer design or can contain multiple layers wherein the base web comprises the inner layer of a two-layer design.

The present disclosure is also directed to a heat but not burn stick. The heat but not burn stick includes a column of an aerosol generating material. A wrapper as described above surrounds the column of the aerosol generating material. The aerosol generating material can be made from any suitable plant matter. For example, in one embodiment, the aerosol generating material is a tobacco, such as cut tobacco, cast leaf tobacco, or reconstituted tobacco leaf produced through a papermaking process. The wrapper of the present disclosure can be incorporated into the heat but not burn stick such that the heat but not burn stick is non-combustible when tested according to a combustion test. For example, when tested according to a combustion test, the heat but not burn stick in accordance with the present disclosure can extinguish in less than about 3 minutes, such as less than about 2.5 minutes, such as less than about 2 minutes, such as less than about 1.5 minutes.

Other features and aspects of the present disclosure are discussed in greater detail below.

BRIEF DESCRIPTION OF THE DRAWINGS

A full and enabling disclosure of the present disclosure is set forth more particularly in the remainder of the specification, including reference to the accompanying figures, in which.

Figure 1:
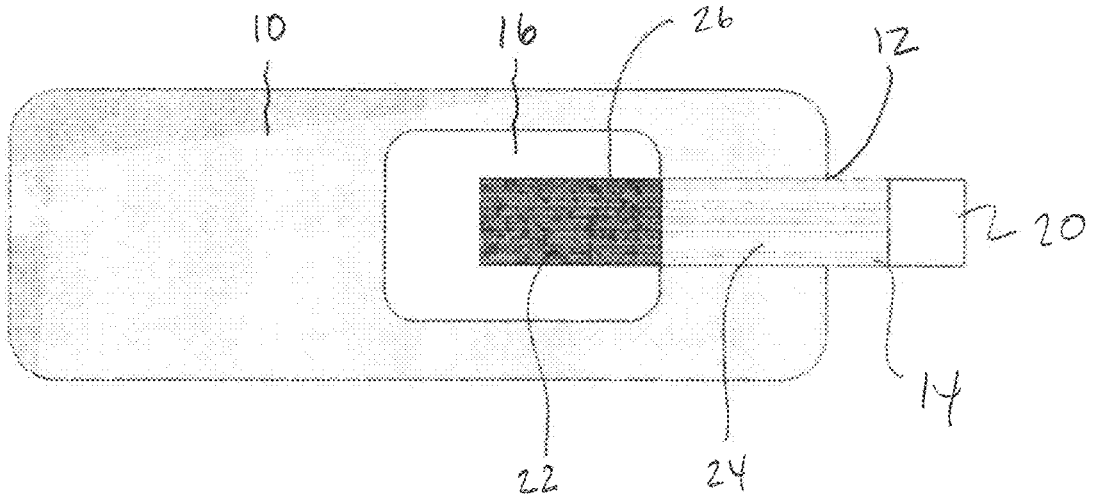
FIG. 1 is a plan view of one embodiment of a heat but not burn device that has been loaded with a heat but not burn stick in accordance with the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present disclosure.

In general, the present disclosure is directed to a paper product with low combustion characteristics. For example, the paper product is well suited for use as a non-combustible wrapper in producing heat but not burn sticks.

The low combustion characteristics can be incorporated into the paper product using various different techniques. Each technique can be used alone or in conjunction with other techniques to optimize a particular product for a desired application. In one aspect, for instance, the paper product of the present disclosure can be made by incorporating into the paper a flame retardant filler, such as silicate particles. In another embodiment, the paper product can contain cellulosic fibers alone or in conjunction with a filler and can be coated on one or both surfaces with a reduced ignition composition. The reduced ignition composition, for instance, can contain a reduced ignition substance, such as a film-forming polymer or cellulose, a particulate or fibrous cellulose material, or a mixture of both. The reduced ignition coating can be used alone or in conjunction with the flame retardant filler. When incorporated into a wrapper for heat but not burn sticks, the paper made in accordance with the present disclosure can be used in a single layer design. Alternatively, the wrapper can contain two layers wherein the paper made in accordance with the present disclosure can form the outer layer or inner layer of the wrapper.

Of particular advantage, the paper of the present disclosure can be made primarily from biodegradable materials making the wrapper environmentally friendly while providing the desired non-combustible properties for heat but not burn applications.

Referring to FIG. 1, one embodiment of an aerosol generating device that may be used in accordance with the present disclosure is shown. The aerosol generating device 10 includes a passageway or opening 12 for receiving a heat but not burn stick 14. The aerosol generating device 10 includes a heating device 16 that heats but does not burn an aerosol generating material contained within the heat but not burn stick 14. The heating device can comprise any suitable heating device capable of exposing the heat but not burn stick 14 to a temperature sufficient to produce an aerosol. The heating device 16, for instance, can comprise an electrical heating element in one embodiment that is powered by a battery and which can be around or inside the aerosol generating material and which can be made of a single or several heating elements. Alternatively, the heating device can produce heat by burning a fuel, such as butane. In still another embodiment, the heating device 16 may include substances that react together in a chemical reaction for producing heat.

As shown in FIG. 1, the heat but not burn stick 14 can have an appearance similar to a conventional cigarette. If desired, the heat but not burn stick 14 can include a mouthpiece or filter 20. The filter 20 can be made from a cellulose acetate tow. In addition to the filter 20, the heat but not burn stick 14 can also include a cooling segment 24. The cooling segment 24 is designed to lower the temperature of an aerosol generated by the heat but not burn stick 14. The aerosol cooling segment 24 can be made from various materials such as cellulose acetate, a crimped polylactide film, or from a perforated paper tube.

The heat but not burn stick 14 further includes a column of an aerosol generating material 22. For example, the aerosol generating material can be a tobacco material. The tobacco material can be a single variety of tobacco or can be a variety of tobacco types blended together. The aerosol generating material can be made of natural leaf tobacco, cast leaf tobacco, expanded tobacco, homogenized tobacco, slurry tobacco, papermaking reconstituted tobacco, and combinations thereof. The tobacco material can also be combined with various other non-tobacco materials, such as filler particles.

In addition to tobacco materials, the aerosol generating material can also comprise various other materials, such as various other plant materials. For instance, in other embodiments, the aerosol generating material can be made from *cannabis* including the buds and flowers of the *cannabis* plant. In still another embodiment, the aerosol generating material can comprise other non-tobacco plant materials, such as various herbs and flowers.

In accordance with the present disclosure, the heat but not burn stick 14 can further include a wrapper 26 that at least covers the aerosol generating material 22. The wrapper 26 is made in accordance with the present disclosure and has low combustion characteristics. The wrapper 26 can be a single layer of paper or can include two or more layers of paper. Optionally, the heat but not burn stick 14 can include a tipping paper that covers the filter 20 and optionally the aerosol cooling segment 24.

Figure 2:
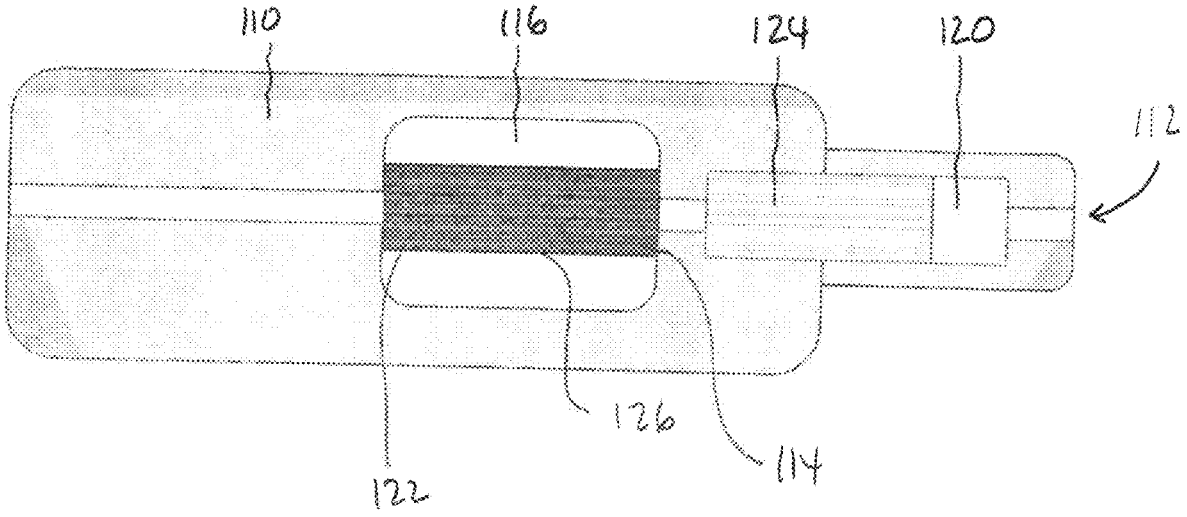
FIG. 2 is a plan view of an alternative embodiment of a heat but not burn device that has been loaded with a heat but not burn stick.

Referring to FIG. 2, another embodiment of an aerosol generating device 110 is illustrated. In this embodiment, the filter 120 and the aerosol cooling segment 124 are built into the aerosol generating device 110. The aerosol generating device 110 includes an opening 112 or mouthpiece through which a user can receive an aerosol. The aerosol generating device 110 includes a heating device 116 that heats but does not burn a heat but not burn stick 114 that is loaded into the device. In this embodiment, the heat but not burn stick 114 does not include an aerosol cooling segment or a filter. Instead, the heat but not burn stick 114 includes a column of an aerosol generating material 122 that is surrounded by a wrapper 126 in accordance with the present disclosure.

Figure 3:
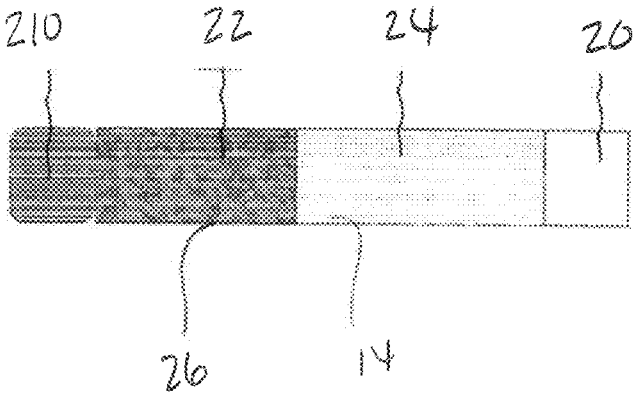
FIG. 3 is still another embodiment of a heat but not burn device in association with a heat but not burn stick.

Referring to FIG. 3, still another embodiment of a heat but not burn device 210 is illustrated. In this embodiment, the heat but not burn stick 14 is substantially the same as the embodiment illustrated in FIG. 1. Thus, like reference numerals have been used to indicate similar elements. The heat but not burn stick 14 includes a filter 20, an aerosol cooling segment 24, and an aerosol generating material 22. The aerosol generating material 22 is surrounded by a wrapper 26 made in accordance with the present disclosure. In this embodiment, the heat but not burn device 210 includes a heating element, such as a coal system, for supplying heat to the heat but not burn stick 14.

The aerosol generating material can contain a humectant for many applications. Humectants that may be used include a polyol, a non-polyol, or mixtures thereof. Polyol humectants include sorbitol, glycerol, propylene glycol, triethylene glycol, or mixtures thereof. Non-polyol humectants include lactic acid, glyceryl diacetate, glyceryl triacetate, triethyl citrate, isopropyl myristate, or mixtures thereof. One or more humectants can be present in the aerosol generating material in an amount from about 0.1% to about 30% by weight. When producing heat but not burn sticks, for instance, the aerosol generating material may contain a humectant in an amount greater than about 3% by weight, such as in an amount greater than about 5% by weight, such as in an amount greater than about 8% by weight, such as in an amount greater than about 10% by weight, such as in an amount greater than about 12% by weight, such as in an amount greater than about 15% by weight, such as in an amount greater than about 18% by weight, and generally in an amount less than about 30% by weight, such as in an amount less than about 25% by weight, such as in an amount less than about 20% by weight.

In accordance with the present disclosure, the aerosol generating material is surrounded by a wrapper. Once the aerosol generating material is wrapped, the heat but not burn stick can generally have a circumference of from about 4 mm to about 95 mm, such as from 4 mm to about 50 mm, such as from about 8 mm to about 25 mm. The length of the stick can generally be from about 1 cm to about 25 cm, such as from about 12 cm to about 20 cm, such as from about 3 cm to about 15 cm, such as from about 4 cm to about 10 cm. The diameter of the heat but not burn stick can be from about 4 mm to about 30 mm, such as from about 5 mm to about 9 mm. In one aspect, for instance, the diameter can be from about 5 mm to about 6 mm. In an alternative embodiment, the diameter can be from about 6.5 mm to about 7.5 mm.

In one aspect, the paper or wrapper of the present disclosure is made from a base web containing cellulosic fibers combined with a flame retardant filler. The cellulosic fibers used to form the base web can be formed from softwood fibers, hardwood fibers, flax fibers, mixtures thereof, and the like. In general, any suitable cellulosic fibers may be used to form the base web. The extent to which the cellulosic fibers are refined can vary depending upon the particular application.

In order to form the base web, the cellulosic fibers are combined with the flame retardant filler and formed into an aqueous suspension. The aqueous suspension is then fed through a headbox and deposited onto a moving forming fabric for forming an embryonic web that is then dried.

The flame retardant filler incorporated into the base web in accordance with the present disclosure, in one embodiment, is a silicate, such as metal silicate particles. In one aspect, the metal silicate particles are calcium silicate particles. The calcium silicate particles can generally have an average particle size of greater than about 0.1 microns, such as greater than about 2 microns, such as greater than about 3 microns, and generally less than about 30 microns, such as less than about 20 microns, such as less than about 10 microns.

Examples of other filler particles that can be used in accordance with the present disclosure include clay particles, metal hydroxide particles, metal oxide particles, carbonate particles, mixtures thereof, and the like. In one aspect, for instance, the filler particles can comprise clay particles. Clay particles particularly well suited for use in the present disclosure include kaolin particles. Metal hydroxide particles are also well suited for use in the present disclosure. For example, in one aspect, the filler particles comprise aluminum hydroxide particles. In other embodiments, kaolin particles can be combined with aluminum hydroxide particles and/or silicate particles. The filler particles can generally have an average particle size of greater than about 0.1 microns, such as greater than about 2 microns, such as greater than about 3 microns, and generally less than about 30 microns, such as less than about 20 microns, such as less than about 10 microns.

The amount of the flame retardant filler incorporated into the base web can vary depending upon the type of cellulosic fibers present and based on various other factors. In general, the flame retardant filler is incorporated into the base web in an amount greater than about 10% by weight, such as in an amount greater than about 15% by weight of the base web, such as greater than about 17% by weight, such as greater than about 19% by weight, such as greater than about 21% by weight, such as greater than about 23% by weight, and generally less than about 40% by weight, such as less than about 35% by weight, such as less than about 30% by weight, such as less than about 28% by weight, such as less than about 26% by weight, such as less than about 24% by weight. In one particular aspect, the flame retardant filler is incorporated into the base web in an amount from about 16% by weight to about 24% by weight.

In one embodiment, the base web can contain the flame retardant filler in an amount from about 20% to about 45% by weight, such as in an amount from about 27% to about 38% by weight. In this embodiment, for instance, the base web can be uncoated. For example, the non-combustion characteristics of the base web can come only from the flame retardant filler without being used in conjunction with any coatings.

In addition to the flame retardant filler, the base web can also contain various other fillers. For instance, the base web can contain calcium carbonate particles, magnesium oxide particles, calcium chloride particles, calcium lactate particles, calcium gluconate particles, or the like. Other fillers can be present in the base web generally in an amount from about 1% to about 12% by weight, such as in an amount from about 3% to about 8% by weight. For instance, the base web can be constructed such that the total filler loading is about 40% by weight or less, such as about 35% by weight or less.

The inherent permeability of the base web is generally less than about 60 CU. As used herein, the "inherent" permeability of the base web refers to the permeability of the base web in an uncoated state such as, for instance, prior to application of a reduced ignition composition. The permeability of the base web can be controlled using various different techniques. For instance, the permeability of the base web can be reduced by increasing the amount the cellulosic fibers are refined and/or decreasing the particle size of the one or more fillers. In one aspect, the permeability of the base web is relatively low which can further improve the non-combustibility characteristics of the wrapper. For instance, the permeability can be less than about 50 CU, such as less than about 30 CU, such as less than about 25 CU, such as less than about 20 CU, such as less than about 15 CU, such as less than about 10 CU. The permeability is generally about 0 CU or greater, such as greater than about 5 CU. In one aspect, the inherent permeability of the base web can be greater than about 10 CU, such as greater than about 20 CU, such as greater than about 30 CU.

The base web can also have an inherent permeability of less than about 100 mL/min, such as less than about 85 mL/min, such as less than about 70 mL/min, such as less than about 55 mL/min, such as less than about 40 mL/min, such as less than about 30 mL/min, such as less than about 20 mL/min, such as less than about 15 mL/min. The permeability can be greater than about 5 mL/min, such as greater than about 10 mL/min, such as greater than about 25 mL/min. The permeability with the above units can be determined according to the test method ISO 5636-3-2013 and is also referred to the Bendtsen permeability. The permeability can be measured using an L & W Air Permeance Tester, manufactured by Lorentzen & Wettre Products.

The basis weight of the base web can be from about 30 gsm to about 100 gsm, including all increments of 1 gsm therebetween. For instance, the basis weight can be from about 30 gsm to about 85 gsm, such as from about 40 gsm to about 80 gsm, such as from about 45 gsm to about 75 gsm. In one aspect, the basis weight can be from about 33 gsm to about 45 gsm. Alternatively, the basis weight can be from about 45 gsm to about 60 gsm. In still another embodiment, the basis weight can be from about 60 gsm to about 85 gsm, such as from about 65 gsm to about 75 gsm. In other embodiments, the basis weight of the base web can generally be about 12 gsm or greater and about 60 gsm or less. For instance, the basis weight can be greater than about 25 gsm, such as greater than about 30 gsm, such as greater than about 35 gsm, and generally less than about 55 gsm, such as less than about 50 gsm, such as less than about 45 gsm. Basis weight can be determined according to the test method ISO 536:2012. The web is conditioned at 23° C. and 50% relative humidity before the measurement is taken.

The base web of the present disclosure can also be treated or contain various different additives in order to improve properties or characteristics. Additives that may optionally be incorporated into the base web include, for instance, burn control agents, wet strength agents, an oil-barrier and/or fat-barrier agent, an anti-blocking agent, a dry strength agent, a softener, a wetting agent, or the like.

The use of burn control agents is optional and may not be desired in various applications. Burn control agents, for instance, may comprise a salt of a carboxylic acid. For example, the burn control agent may comprise an alkali metal salt of a carboxylic acid, an alkaline earth metal salt of a carboxylic acid, or mixtures thereof. Examples of burn control agents that may be used include a salt of acetic acid, citric acid, malic acid, lactic acid, tartaric acid, carbonic acid, formic acid, propionic acid, glycolic acid, fumaric acid, oxalic acid, malonic acid, succinic acid, nitric acid, phosphoric acid, or mixtures thereof. Particular burn controlling agents that may be used include potassium citrate, sodium citrate, potassium succinate, sodium succinate, or mixtures thereof. When present, one or more burn control agents are usually used in very small amounts. For instance, one or more burn control agents can be applied to the base web in an amount less than 1% by weight, such as less than about 0.5% by weight, such as less than about 0.1% by weight. In one embodiment, the base web or wrapper of the present disclosure can be completely free of any burn control agents, such as the burn control agents described above.

A wet strength agent may reduce the potential for degradation of the base web if the latter is placed in contact with a liquid, such as water. Typically, the wet strength agent may be chosen from polyamides, such as epichlorohydrin resin, a polyamine-epichlorohydrin resin, a poly(aminoamide)-epichlorohydrin resin, a urea-formaldehyde resin, a melamine-formaldehyde resin; an alkyl-ketene dimer; alkylsuccinic anhydride; a polyvinylamine; an oxidized polysaccharide. Typically, the amount of wet strength agent is from 0.1% to 30%, preferably from 1% to 15%, even more preferentially from 5% to 10% by dry weight of the wrapping material.

An antiblocking agent may limit the adhesion of a material to the wrapper or coated paper. Typically, the antiblocking agent may be chosen from carboxymethylcellulose, polyacrylamides, acrylic esters, silicones and latices.

A dry strength agent may increase the resistance of the base web if the latter is subjected to large mechanical stresses. The dry strength agent may be chosen from starches and modified gums, cellulose polymers, synthetic polymers, for instance carboxymethylcellulose and polyacrylamides. Typically, the amount of dry strength agent is from 0.1% to 15%, preferably from 1% to 10%, even more preferentially from 1% to 5% by dry weight of the wrapping material.

A softener may improve the softness of the base web. Typically, a softener is a fatty acid, a siloxane compound, a silicone compound, an aminosilicone compound, an extract of aloe vera, an extract of sweet almond, an extract of camomile, a quaternary ammonium compound. Typically, the amount of softener is from 0.1% to 30%, such as from 1% to 3%, by dry weight of the base web.

In accordance with the present disclosure, base webs as described above can optionally be further treated with a reduced ignition composition. For instance, a coating can be disposed on one side or both sides of the base web comprising the reduced ignition composition.

In general, any suitable ignition reducing composition can be applied to the base web. In one embodiment, for instance, the reduced ignition composition contains a natural or synthetic polymer. For example, reduced ignition substances that can be used in accordance with the present disclosure include alginates, guar gum, pectin, polyvinyl alcohol, polyvinyl acetate, cellulose derivatives such as ethyl cellulose, methyl cellulose, and carboxymethyl cellulose, starch, starch derivatives, and the like. The reduced ignition substance can also comprise other cellulose-based materials, such as cellulose particles, cellulose fibers or microcrystalline cellulose including colloidal microcrystalline cellulose.

In one particular embodiment, the reduced ignition substance may comprise an alginate, alone or in combination with starch. In general, an alginate is a derivative of an acidic polysaccaride or gum which occurs as the insoluble mixed calcium, sodium, potassium and magnesium salt in the Phaeophyceae brown seaweeds. Generally speaking, these derivatives are calcium, sodium, potassium, and/or magnesium salts of high molecular weight polysaccarides composed of varying proportions of D-mannuronic acid and L-guluronic acid. Exemplary salts or derivatives of alginic acid include ammonium alginate, potassium alginate, sodium alginate, propylene glycol alginate, and/or mixtures thereof.

In one embodiment, a relatively low molecular weight alginate may be used. For example, the alginates may have a viscosity of less than about 500 cP when contained in a 3% by weight aqueous solution at 25° C. More particularly, the alginates may have a viscosity of less than 250 cP at the above conditions, particularly less than 100 cP, and in one embodiment at a viscosity of about 20-60 cP. As used herein, viscosity is determined by a Brookfield LVF Viscometer with a suitable spindle according to the viscosity. At the above lower viscosity levels, alginate compositions can be formed at a higher solids content, but yet at a low enough solution viscosity to permit the application of the composition to the base web using conventional techniques. For example, the solids content of an alginate solution made in accordance with the present disclosure can be greater than about 6%, particularly greater than about 10%, and more particularly from about 10% to about 20% by weight.

At the above solids levels, alginate compositions can have a solution viscosity of greater than about 250 cP, particularly greater than about 500 cP, more particularly greater than about 800 cP, and in one embodiment at a viscosity of greater than about 1,000 cP at 25° C. In general, the solution viscosity of the alginate composition can be adjusted depending upon the manner in which the composition is being applied to the base web. For instance, the solution viscosity of the composition can be adjusted depending upon whether or not the composition is being sprayed onto the paper or printed onto the paper.

In other embodiments, it should also be understood that depending upon the application a relatively high molecular weight alginate may be used. For example, the alginate may have a viscosity of greater than about 500 cP when contained in a 3% by weight aqueous solution at 25° C.

As indicated above, the reduced ignition composition may also comprise a cellulose material, which can be cellulose slurry (a type of dispersion) or a cellulose gel. The cellulose material applied to the base web may comprise fibrous cellulose, one or more fillers, and/or cellulose particles. As used herein, cellulose fibers and cellulose particles are to be differentiated from derivatized cellulose such as carboxymethyl cellulose. Cellulose fibers and cellulose particles, for instance, are not completely water soluble.

In one embodiment, the cellulose material applied to the paper substrate may comprise microcrystalline cellulose. The microcrystalline cellulose can be ground microcrystalline cellulose, powdered microcrystalline cellulose, or colloidal microcrystalline cellulose. In one aspect the microcrystalline cellulose is colloidal microcrystalline cellulose that has been depolymerized. Colloidal microcrystalline cellulose can form a gel when combined with water. The microcrystalline cellulose can have an average particle size of less than about 2 microns, such as less than about 1 micron, such as less than about 0.5 microns, such as less than about 0.3 microns, and generally greater than about 0.001 microns, such as greater than about 0.06 microns.

In one embodiment, a cellulose material, such as microcrystalline cellulose, can be combined with one of the other ignition reducing substances identified above such as an alginate, a starch, or mixtures thereof.

In one embodiment, the reduced ignition composition can further contain a viscosity modifier (also referred to as a spacer). The viscosity modifier, for instance, can be a cellulose derivative, such as carboxy methylcellulose. The viscosity modifier can be present in the reduced ignition composition generally in amounts less than about 20% by weight, such as in amounts less than about 15% by weight, such as in amounts less than about 10% by weight, such as in amounts less than about 5% by weight, and generally in an amount greater than about 1% by weight.

In one aspect, the reduced ignition composition contains colloidal microcrystalline cellulose in a gel comprising about 8% to about 30% solids in water. The composition can contain about 3% to about 8% calcium carbonate particles, from about 2% to about 20% of a cellulose derivative such as a sodium salt of carboxymethyl cellulose, and from about 60% to about 95% microcrystalline cellulose on a dry basis.

In addition to an alginate, a starch, guar gum, pectin, polyvinyl alcohol, polyvinyl acetate, a cellulose derivative, a microcrystalline cellulose, cellulose fibers or particles, a starch derivative, or mixtures thereof, the reduced ignition composition applied to the base web can contain various other ingredients. For instance, in one embodiment, a filler can be contained within the composition as described above. The filler can be, for instance, calcium carbonate, calcium chloride, calcium lactate, calcium silicate, calcium gluconate, and the like. In addition to calcium compounds, other various particles may be used including magnesium compounds such as magnesium oxide, clay particles, and the like.

The reduced ignition composition, in one embodiment, can be water based. In particular, the reduced ignition composition may comprise an aqueous dispersion, an aqueous gel, or an aqueous solution. Alternatively, the reduced ignition composition prior to being applied to the paper wrapper may comprise a non-aqueous gel, solution or dispersion. In this embodiment, for instance, an alcohol may be present for applying the composition to the wrapper.

The reduced ignition composition can be applied to the base web using any suitable technique in order to form a coating. For instance, the reduced ignition composition can be sprayed, brushed, applied with a moving orifice, or printed onto the base web. In one aspect, the reduced ignition composition is applied to the base web using gravure printing. The coating can be formed by applying the reduced ignition composition in a single pass onto the base web or using a multiple pass operation.

The amount that one side of the base web is coated can vary depending upon the particular application. In one embodiment, the reduced ignition composition forms a continuous coating over a surface of the base web. For instance, the coating can cover greater than about 65% of the surface area of one side of the base web, such as greater than about 80% of the surface area, such as greater than about 85% of the surface area, such as greater than about 90% of the surface area, such as greater than about 95% of the surface area, such as greater than about 98% of the surface area of one side of the base web. In one particular embodiment, the reduced ignition composition can cover 100% of the surface area of one side of the base web.

Alternatively, the coating can be applied in discrete areas to one side of the base web. In this manner, the base web includes treated areas and untreated areas with the reduced ignition composition. The reduced ignition composition, for instance, can be applied to a surface of the base web in any particular pattern. For example, in one embodiment, the reduced ignition composition can be applied to the base web in the form of circumferential bands having a width of from about 3 mm to about 20 mm. When applied in a discontinuous manner, the reduced ignition composition can cover greater than about 40%, such as greater than about 50%, such as greater than about 60%, such as greater than about 70% of the surface area of one side of the base web. When applied in a discontinuous manner, the reduced ignition composition can cover less than about 90%, such as less than about 80% of the surface area of one side of the base web.

In general, the reduced ignition composition can be applied to the base web in an amount greater than about 0.5 gsm (the dried coating weight). The above amounts are directed to areas where the base web is coated. For instance, the coating can have a basis weight of greater than about 1 gsm, such as greater than about 4 gsm, such as greater than about 6 gsm, such as greater than about 8 gsm, and generally less than about 10 gsm, such as less than about 7 gsm, such as less than about 5 gsm. In one embodiment, the coating has a basis weight (where applied to the base web) of from about 1 gsm to about 5 gsm.

Once coated, the base web or wrapper can have a relatively low permeability within the coated areas. For example, within the coated areas, the permeability of the base web can be less than about 10 CU, such as less than about 8 CU, such as less than about 6 CU, such as less than about 4 CU, such as less than about 2 CU, such as less than about 1 CU. The permeability within the coated areas, for instance, can be from about 0 CU to about 5 CU.

Within the coated areas, the permeability can be less than about 25 mL/min, such as less than about 20 mL/min, such as less than about 15 mL/min, such as less than about 10 mL/min, such as less than about 5 m L/min, and generally greater than about 0, such as greater than about 0.1 mL/min, such as greater than about 1 mL/min.

In addition to having a relatively low permeability, the coated areas of the base web or wrapper also have a relatively low diffusivity. The diffusivity can be measured at room temperature (23° C.). In general, the diffusivity at 23° C. of the coated areas of the base web or wrapper is less than about 0.1 cm/s, such as less than about 0.05 cm/s, such as less than about 0.04 cm/s, such as less than about 0.03 cm/s, such as less than about 0.02 cm/s. The diffusivity in the coated areas is zero or generally greater than about 0.0001 cm/s. Diffusivity is measured using a Sodim CO2 diffusivity tester.

Base webs coated with a reduced ignition composition as described above can be used alone or in conjunction with a flame retardant filler incorporated into the base web. Desired non-combustion characteristics can be obtained, however, in some applications without using the flame retardant filler. For example, in one embodiment, the base web made in accordance with the present disclosure can include a continuous coating of the flame retardant composition. The flame retardant composition can contain a reduced ignition substance, such as an alginate, a cellulose material such as colloidal microcrystalline cellulose, or can contain a combination of materials. The coating can cover at least about 65% of the surface area of the base web, such as at least about 80% of the surface area of the base web. Within the coated areas, the permeability of the base web can be less than about 10 CU, such as less than about 5 CU, such as less than about 1 CU. The diffusivity within the coated areas can be less than about 0.04 cm/s. In this embodiment, the base web can be free of any filler particles. Alternatively, a filler can be incorporated into the base web, such as calcium carbonate particles, magnesium oxide particles, or the like. The filler can be incorporated into the base web in an amount from about 10% to about 25% by weight. In one aspect, the filler can be present in the base web in an amount greater than 16% by weight.

Papers made in accordance with the present disclosure are well suited for use as wrappers for heat but not burn sticks. As described above, the paper can be constructed so that the paper is non-combustible. When incorporated into a wrapper, the wrapper can contain a single layer made from the paper or can include a plurality of layers, such as two layers. For example, in one embodiment, the wrapper can include two layers and the paper of the present disclosure can be the inner layer surrounded by an outer layer. Alternatively, the coated paper can be the outer layer surrounding an inner layer.

The paper wrapper that is used in conjunction with the paper of the present disclosure to form a two-layer wrapper can vary depending upon the particular circumstances and desired result. For example, the opposing layer can be made from cellulosic fibers and can contain a filler, such as a white filler made from calcium carbonate or magnesium oxide. The paper can also contain a binder, such as carboxymethyl cellulose, guar gum, or mixtures thereof. An optical brightener can also be incorporated into the paper.

Once a wrapper in accordance with the present disclosure is incorporated into a heat but not burn stick, the heat but not burn stick can be tested for combustibility. The heat but not burn sticks, for instance, can be tested according to a "Combustion Test" as follows.

In order to test for combustibility, two sets of 20 heat but not burn sticks can be placed in a Borgwaldt RM20 kit machine and tested according to static conditions. The heat but not burn sticks are placed in a horizontal position in the above smoking machine and then lighted using a hotwire coil. After the heat but not burn stick is ignited, the heat but not burn stick is allowed to burn (or extinguish) under static conditions without being subjected to any puffs. After 15 seconds, a picture is taken of the combustion zone. The combustion zone is marked on the photograph or digital image. Pictures are then taken after one minute, two minutes and three minutes. The mark corresponding to the combustion line after 15 seconds is placed on the pictures taken after one minute, two minutes, and three minutes. After three minutes, if the combustion line goes over the previously marked area, the heat but not burn stick and wrapper are classified as combustible paper. If the combustion line initially drawn does not change over the three-minute period, then the heat but not burn stick and the wrapper are classified as non-combustible.

Heat but not burn sticks incorporating the coated paper of the present disclosure can self-extinguish according to the Combustion Test prior to the three-minute time interval. Heat but not burn sticks made according to the present disclosure, for instance, can self-extinguish in less than two minutes, such as less than one minute, when tested using the test described above.

In one aspect, the heat but not burn sticks can be tested according to ISO 3308:2012 smoking regime conditions. In order to test for combustibility, two sets of 20 heat but not burn sticks can be placed in a Borgwaldt RM20 kit machine and tested. The smoking machine is smoked with a puff volume of 35 mL±0.3 for a puff duration of 2 seconds. The puff frequency is every 60 seconds with no vent blocking. The heat but not burn stick is inserted into the stick holder of the machine and lit with the first puff. If the combustion does not restart with the second puff, the heat but not burn stick is considered to be non-combustible.

Another test is conducted according to ISO 20778:2018 smoking regime conditions in which the puff volume is 55 mL±0.6 and the puff frequency is every 30 seconds. The puff duration is 2 seconds without vent blocking. Heat but not burn sticks made according to the present disclosure can be considered non-combustible under each of the above tests.

The present disclosure may be better understood with reference to the following examples.

EXAMPLE NO. 1

Various different tobacco wrappers were made and incorporated into a heat but not burn stick. Some heat but not burn sticks included a tobacco wrapper having a single layer. In other samples, the tobacco wrapper was a two-layer construction.

In this example, the aerosol generating material contained within the heat but not burn stick was a commercially available tobacco material. For the samples containing a single layer wrapper, the tobacco material was a papermaking reconstituted tobacco. Leaflets were cut and then the cut filler was wrapped with a single layer wrapper. The sticks had a diameter of 5.2 mm and did not contain a filter. For the samples containing a double layer wrapper, a crimped cast leaf tobacco was used. The heat but not burn sticks had a diameter of 7.3 mm and included a filter. The outer wrapper used was a conventional wrapper used in heat but not burn sticks.

In the two layer wrapper samples, the inner layer is described in the table below.

The following papers were tested according to the Combustion Test as described above. The following results were obtained:

| | Number of layers of wrapper | Basis weight ($g/m^2$) | Filler type | Filler level ($g/m^2$) | Filler level (%) | Coating composition |
|---|---|---|---|---|---|---|
| Paper#1 | 2 | 40 | $CaCO_3$ | 12.4 | 31 | — |
| Paper#2 | 1 | 41 | Kaolin | 12.5 | 31 | — |
| Paper#3 | 2 | 41 | $Al(OH)_3$ | 12.5 | 31 | — |
| Paper#4 | 2 | 41 | Calcium silicate | 12.3 | 30 | — |
| Paper#5 | 2 | 31 | $CaCO_3$ | 4.3 | 14 | Microcrystalline cellulose gel |
| Paper#6 | 2 | 39 | — | — | | Microcrystalline cellulose gel |
| Paper#7 | 2 | 31 | $CaCO_3$ | 4.3 | 14 | Alginate |
| Paper#8 | 2 | 39 | — | — | | Alginate |
| Paper#9 | 2 | 38 | Calcium silicate | 6.2 | 16 | Microcrystalline cellulose gel |
| Paper#10 | 2 | 38 | Calcium silicate | 6.2 | 16 | Alginate |
| Paper#11 | 1 | 31 | $CaCO_3$ | 4.3 | 14 | Microcrystalline cellulose gel |
| Paper#12 | 1 | 31 | $CaCO_3$ | 4.3 | 14 | Alginate |

| | Coating level ($g/m^2$) | Permeability (CU) | Combustion Test | Mechanism | Diffusivity (cm/s) |
|---|---|---|---|---|---|
| Paper#1 | — | 35 | Combustible | | — |
| Paper#2 | — | 12 | Combustible | Flame retardant filler | — |
| Paper#3 | — | 27 | Combustible | Flame retardant filler | — |
| Paper#4 | — | 48 | Non-combustible | Flame retardant filler | — |
| Paper#5 | 3.9 | <1 | Non-combustible | Oxygen barrier | 0.015 |
| Paper#6 | 3.7 | 1 | Non-combustible | Oxygen barrier | 0.014 |
| Paper#7 | 4.1 | <1 | Non-combustible | Oxygen barrier | 0.015 |
| Paper#8 | 3.7 | <1 | Non-combustible | Oxygen barrier | 0.015 |
| Paper#9 | 5.0 | <1 | Non-combustible | Flame retardant filler + oxygen barrier | 0.004 |
| Paper#10 | 4.7 | <1 | Non-combustible | Flame retardant filler + oxygen barrier | 0.011 |
| Paper#11 | 3.4 | <1 | Non-combustible | Flame retardant filler + oxygen barrier | 0.015 |
| Paper#12 | 5.8 | <1 | Non-combustible | Flame retardant filler + oxygen barrier | 0.012 |

Figure 4:
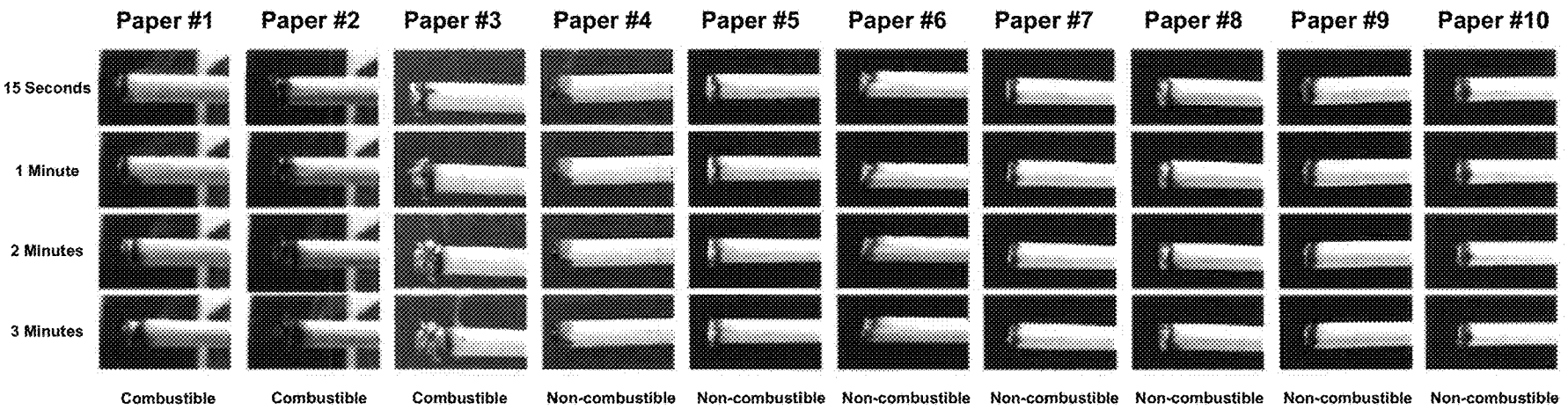
FIGS. 4 and 5 illustrate some of the results obtained in the examples below.
Figure 5:
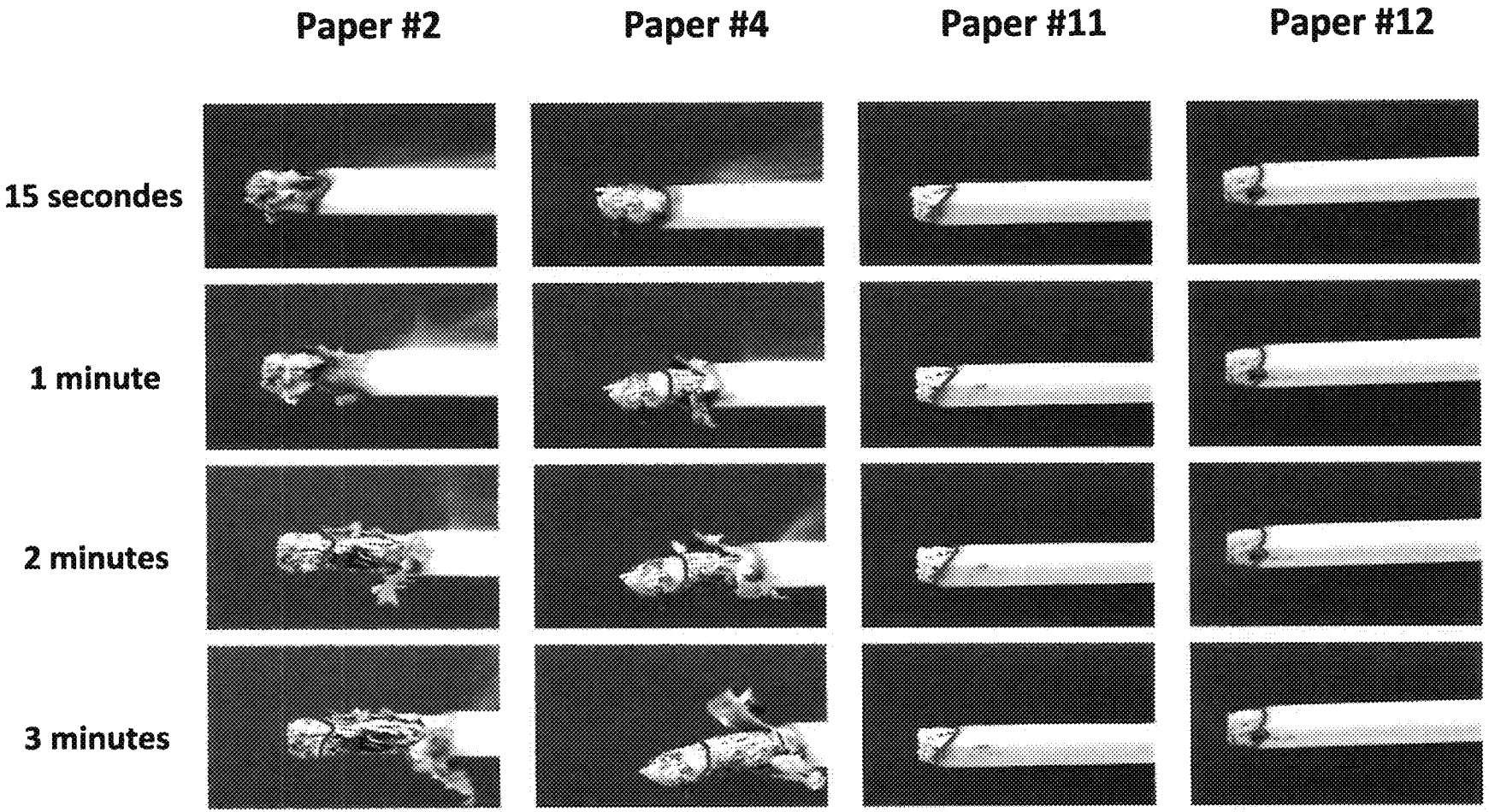

FIGS. 4 and 5 are illustrations of the combustion test conducted on each of the samples above.

EXAMPLE NO. 2

Paper Nos. 9 and 10 above were used to produce heat but not burn sticks in single wrap and double wrap configurations. The heat but not burn sticks were then tested according to the same procedures in Example No. 1 above (static conditions). The heat but not burn sticks were also tested according to ISO Test 3308 in which the smoking machine was set to exert a two-second puff (35 mL) every minute. Two heat but not burn sticks were tested for each test. The following results were obtained.

| | Single wrap | | Double wrap | |
|---|---|---|---|---|
| | Static burn rate | ISO smoking regime | Static burn rate | ISO smoking regime |
| Calcium silicate + alginate | Not combustible (2/2) | Combustible (2/2) | Not combustible (2/2) | Combustible (2/2) |

-continued

| | Single wrap | | Double wrap | |
|---|---|---|---|---|
| | Static burn rate | ISO smoking regime | Static burn rate | ISO smoking regime |
| (coating) Paper #10 Calcium silicate + MCC gel (coating) Paper #9 | Not combustible (2/2) | Not combustible (2/2) | Not combustible (2/2) | Not combustible (1/2) Combustible (1/2) |

(n/n): nbr of sticks in the category (combustible or not combustible)/nbr of sticks evaluated As shown above, the papers made according to the present disclosure show non-combustible properties when tested according to static conditions. When tested according to dynamic conditions, Paper No. 9 still showed robust non-combustible properties.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A wrapper for a heat but not burn stick comprising:

a base web comprising cellulosic fibers combined with a flame retardant filler, the base web having a first side and a second and opposite side, the flame retardant filler comprising metal silicate particles, the metal silicate particles comprising greater than about 15% by weight of the base web and comprising less than 35% by weight of the base web; and a coating disposed on the first side of the base web, the coating comprising a reduced ignition composition.

2. A wrapper as defined in claim 1, wherein the metal silicate particles are uncoated and wherein the metal silicate particles have an average particle size of from about 0.1 microns to about 30 microns.

3. A wrapper as defined in claim 1, wherein the base web has an inherent permeability of from about 0 CU to about 20 CU, wherein the base web has a basis weight of from about 12 gsm to about 100 gsm, wherein the coating has a basis weight of less than 5 gsm.

4. A wrapper as defined in claim 1, wherein the coating of the reduced ignition composition is continuous, the first side of the base web having a surface area and wherein the coating covers greater than about 80% of the surface area of the first side of the base web.

5. A wrapper as defined in claim 1, wherein the wrapper is a single layer wrapper.

6. A wrapper as defined in claim 1, wherein the wrapper includes a plurality of layers, the base web comprising one of the layers.

7. A wrapper for a heat but not burn stick comprising:

a base web comprising cellulosic fibers combined with a flame retardant filler, the base web having a first side and a second and opposite side, the flame retardant filler comprising kaolin particles or metal hydroxide particles comprising greater than about 15% by weight of the base web and comprising less than 35% by weight of the base web; and a coating disposed on the first side of the base web, the coating comprising a reduced ignition composition.

8. A wrapper as defined in claim 7, wherein the flame retardant filler particles comprise aluminum hydroxide particles.

9. A wrapper as defined in claim 7, wherein the flame retardant filler particles comprise kaolin particles.

10. A wrapper as defined in claim 7, wherein the base web has an inherent permeability of from about 0 CU to about 20 CU, wherein the base web has a basis weight of from about 30 gsm to about 100 gsm, wherein the coating has a basis weight of less than 5 gsm.

11. A wrapper as defined in claim 7, wherein the coating of the reduced ignition composition is continuous, the first side of the base web having a surface area and wherein the coating covers greater than about 80% of the surface area of the first side of the base web.

12. A wrapper as defined in claim 7, wherein the reduced ignition composition comprises an alginate, a starch or mixtures thereof.

13. A wrapper as defined in claim 7, wherein the wrapper is a single layer wrapper.

14. A wrapper as defined in claim 7, wherein the wrapper includes a plurality of layers, the base web comprising one of the layers.

15. A heat but not burn stick comprising:

a column of an aerosol generating material; and a wrapper as defined in claim 7, the wrapper surrounding the column of the aerosol generating material.

16. A heat but not burn stick as defined in claim 15, wherein the aerosol generating material comprises a tobacco.

17. A wrapper for a heat but not burn stick comprising:

a base web comprising cellulosic fibers, the base web having a first side and a second and opposite side; and a continuous coating disposed on the first side of the base web, the coating comprising a reduced ignition composition, the reduced ignition composition comprising a polymer material, a cellulose material, or mixtures thereof, the base web having a permeability where coated with the reduced ignition composition of less than about 5 CU and having a diffusivity of less than 0.04 cm/s as determined by a $CO_2$ diffusivity tester, the first side of the base web having a surface area and wherein the reduced ignition composition covers greater than about 40% of the surface area of the first side of the base web.

18. A wrapper as defined in claim 17, wherein the reduced ignition composition comprises an alginate, a starch, or mixtures thereof.

19. A wrapper as defined in claim 17, wherein the reduced ignition composition covers greater than about 80% of the surface area of the first side of the base web.

20. A wrapper as defined in claim 17, wherein the base web further contains flame retardant filler particles in an amount from about 10% to about 40% by weight.

21. A wrapper as defined in claim 17, wherein the base web does not contain any filler particles.

22. The wrapper as defined in claim 1, wherein the base web is formed from an aqueous suspension including the cellulosic fibers and the flame retardant filler.

23. The wrapper as defined in claim 1, wherein the base web has a basis weight of less than 35 gsm.

* * * * *